US005239522A

United States Patent [19]

Corlet

[11] Patent Number: 5,239,522

[45] Date of Patent: Aug. 24, 1993

[54] METHOD FOR THE SETTING OF THE PERPETUAL CALENDAR OF AN ANALOGIC QUARTZ CHRONOGRAPH AS WELL AS A QUARTZ CHRONOGRAPH FOR CARRYING IT OUT

[75] Inventor: John Corlet, La Cote-Aux-Fees, Switzerland

[73] Assignee: Complications SA, La Cote-Aux-Fees, Switzerland

[21] Appl. No.: 829,279

[22] Filed: Feb. 3, 1992

[30] Foreign Application Priority Data

Feb. 5, 1991 [CH] Switzerland ..... 345/91

[51] Int. Cl.[5] ..... G04B 19/24

[52] U.S. Cl. ..... 368/31; 368/185; 368/28

[58] Field of Search ..... 368/28–40, 368/184–199

[56] References Cited

U.S. PATENT DOCUMENTS

| | | | |
|---|---|---|---|
| 4,114,362 | 9/1978 | Frederiksen | 368/31 |
| 4,674,889 | 6/1987 | Klaus | 368/31 |
| 4,695,168 | 9/1987 | Meister et al. | 368/31 |
| 4,766,579 | 8/1988 | Sporing | 368/31 |
| 4,775,963 | 10/1988 | Soltermann | 368/31 |
| 5,093,814 | 3/1992 | Beson et al. | 368/31 |

FOREIGN PATENT DOCUMENTS

| | | |
|---|---|---|
| 0267440 | 5/1988 | European Pat. Off. . |
| 2404250 | 4/1979 | France . |
| 63-214686 | 9/1988 | Japan . |
| WO89/04512 | 5/1989 | World Int. Prop. O. . |

OTHER PUBLICATIONS

"Le chronographe-bracelet analogique le plus complet du monde", *Actes du Congres Europeen de Chronometrie*, No. 1, Sep., 1988, By E. Favre et al., pp. 101–106.

*Primary Examiner*—Bernard Roskoski

*Attorney, Agent, or Firm*—Young & Thompson

[57] ABSTRACT

The invention relates to a setting method of the perpetual calendar of a chronograph watch having an analogic display and comprising a watch case, a time setting stem and two chronograph pushers. The display comprises a dial provided with an hour and a minute graduation as well as a centered chronograph hand and eccentric chronograph counters for the minutes and the hours each presenting a graduation, a corresponding hand and a date display. The watch comprises at least a driving motor for these hands and an electronic circuit provided with a processor controlled by a quartz time base. The setting of the perpetual calendar, number of the years within a cycle of four years, number of the months of the year, and indication of the date is controlled by the time setting stem and the two chronograph pushers. During the setting process, one displays the value of each of the parameters to be set successively by one of the hands and of the corresponding graduation.

4 Claims, 3 Drawing Sheets

METHOD FOR THE SETTING OF THE PERPETUAL CALENDAR OF AN ANALOGIC QUARTZ CHRONOGRAPH AS WELL AS A QUARTZ CHRONOGRAPH FOR CARRYING IT OUT

In an electronic or quartz analogic watch it is possible to take account purely electronically of the irregularity of the number of days within the month of the year as well as of the supplemental day in the month of February of the bissextile years. Doing so it is only necessary to set the number of the year 1 to 4 in a cycle of four years, the number of the month of the year and the number of the days of the month so that these indications remain correct during the whole duration of the working of the movement, that is during the life time of the accumulator. At the time the accumulator arrives at the end of its life and that the voltage is no more sufficient these data are lost and at the replacement of the battery, it is not only necessary to set the watch again at the right time but also to reset its perpetual calendar.

This setting of the perpetual calendar of the quartz analogic watches is currently performed by a watchmaker by means of an apparatus which is separate from the watch and this has the drawback that the user cannot change its battery himself, nor generally have it changed immediately at a selling point which is not equipped with the adequate instruments.

There is known from U.S. Pat. No. 5,093,814 an analogic quartz watch, the perpetual calendar of which can be programmed by means of the winding stem of the watch. This realization has several drawbacks. Particularly it is necessary to have, only for the programmation of the perpetual calendar, three different axial positions of the winding and time setting stem, therefore at least five positions of this stem if it is necessary to have a time setting position as well as a neutral rest position for said stem. This leads to important axial displacements of this winding stem which makes it fragile and furthermore the user never knows in a secure manner in which position the stem is.

Furthermore, this solution cannot be envisaged for a chronograph since it would be necessary to provide one, eventually two, supplemental axial positions for the stem to correct the chronograph displays and eventually the function of setting of time zones.

Further the solution proposed in this document necessitates a complete programmation of the perpetual calendar at each battery change and this is an inconvenience for the user.

There is further known from FR 2.404.250 a chronograph without perpetual calendar the chronograph pushers of which have a supplemental function, that of displaying by means of one hand of the watch another indication which is stored in the watch, for example an alarm time. This supplemental function of the chronograph pushers does not modify or interfere in any way with the working of the watch movement and can in no way modify its initial conditions.

The present invention has for its aim to enable a setting of the perpentual calendar of a chronograph and not of a watch, which obviates all the precited drawbacks, that is the use of a device which is external to the chronograph and which does not necessitate a complete new setting of the perpetual calendar when the battery is changed.

The present invention has for its object a method for the setting of a perpetual calendar of a quartz chronograph by means of elements integrated to this chronograph which obviates the precited drawbacks as well as a chronograph to carry out this method.

This invention relates to a method for setting a quartz chronograph of a chronograph watch having an analogic display comprising a watch case, a time setting stem and two chronograph pushers; a dial provided with a hour and a minute graduation as well as a centred chronograph hand and eccentric chronograph displays for the minutes and the hours each presenting a graduation and a corresponding hand; at least a driving motor for these hands and an electronic circuit provided with a processor driven by a quartz time base and a date display, characterized by the fact that the setting of the perpetual calendar, number of the years within a cycle of four years, number of the months of the year, and indication of the date is controlled by means of the time setting stem and the two chronograph pushers and by the fact that one displays each of the parameters to be set successively by means of one of the hands and of the corresponding graduation.

This invention relates also to a chronograph having an analogic display comprising a watch, a time setting stem and two chronograph pushers; a dial provided with a hours and minutes graduation and a centred chronograph hand as well as eccentric chronograph displays for the minutes and the hours, each presenting a graduation and a corresponding hand as well as a date display comprising a circular eccentric graduation and a corresponding hand; at least two motors for the driving of these hands and an electronic circuit provided with the processor, controlled by a quartz time base and a date display, characterized by the fact that it comprises a time setting stem having three axial positions, one of which causes through switches the realization of the setting mode and by the fact the chronograph pushers permit the sequential setting of the perpetual calendar, year, month, day and hour successively and the display through the chronograph seconds hand of the set parameter.

The attached drawings show schematically and by way of example one embodiment of the method for the setting of the chronograph according to the invention.

Figure 1:
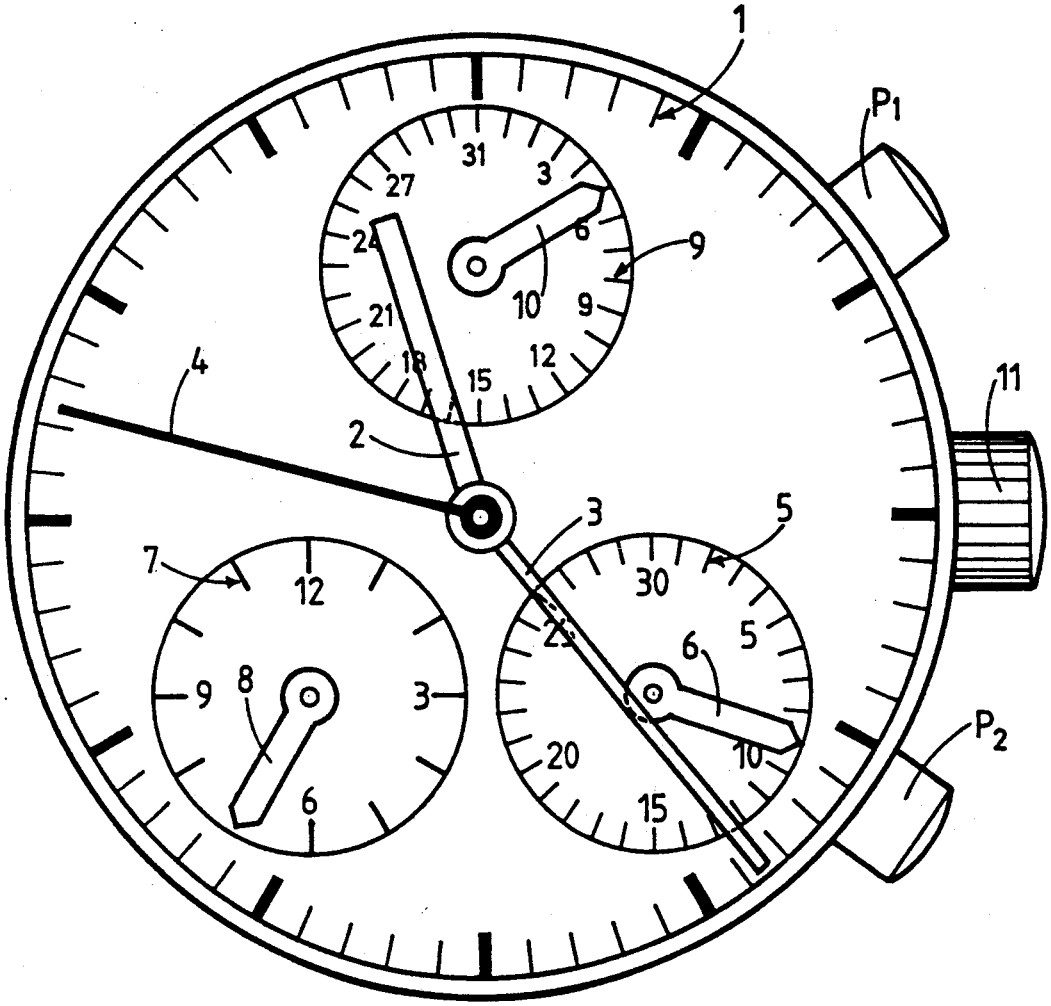
FIG. 1 is a top view of the chronograph.

The chronograph watch shown schematically in FIG. 1 comprises an analogical display presenting an hour graduation and a minute graduation 1 which is circular and concentric to the hours hand 2 and minutes hand 3. This display comprises further a seconds hand of the chronograph 4 at the center cooperating with the graduation 1, a chronograph counter of 30 minutes, presenting a graduation 5 and a hand 6 located at five o'clock and a chronograph counter of 12 hours, presenting a graduation 7 as well as a hand 8 located at seven o'clock. Finally, this display comprises a day date display, comprising a graduation of 31 steps 9 as well as a hand 10 located at noon.

The chronograph comprises further a time setting stem having three axial positions, terminated by a crown 11, and two chronograph pushers P1 and P2.

The movement of the watch chronograph comprises three motors controlled by an electronic circuit comprising a microprocessor.

The minutes hand 3 and the hour hand 2 as well as the hands for the indication of the day date are driven by mechanical demultiplication through a first motor at a normal frequency of 1/12Hz and having a rapid forward speed of 64 Hz and a rearward quick speed of 32 Hz.

The time information is displayed up to the day date but it is calculated up to the year taking account of the bissextile years by means of the microprocessor.

The stem being pulled in intermediate position, it is possible to change the time zone forward or backward according to the direction of rotation of the time setting stem.

The driving of the hour hand is effected mechanically, whereas the electronic state is set to the day by means of contact of the crown 11.

The setting of the time modifies the information of the perpetual counter, day data, month and year.

When pulling the crown 11 up to its second position, the display of the watch stops. One can then proceed to the time setting of the watch forward or rearward, step by step, each step having a fifth of second. Time setting is performed on the whole information of the perpetual counter from the second up to the year.

When pushing the stem back, the minutes hand makes the next step after twelve seconds (hour top). IN chronograph mode the time setting stem is in normal position and the time display runs continuously.

The chronograph comprises two chronograph motors. The first chronograph motor drives the center seconds hand which makes one revolution per minute. This motor comprises a normal frequency of 5 Hz and a rapid speed forward of 64 Hz as well as a rear rapid speed of 32 Hz.

The second chronograph motor drives the minutes hand 6 and the hours hand 8 of the chronograph display. This motor has a normal frequency of one step per minute and a forward rapid speed of 64 Hz as well as a rearward rapid speed of 32 Hz.

The crown 11 being in normal position, a pressure on the pusher P1 permits to start the chronograph. One is then in the normal simple chrono mode (START).

As from the preceeding state (START), it is possible to stop the moving of the chrono hands in two ways :

a. Through a pressure on P1, the movement of the hands and of the counter stops.

After reading the measured time, one can :

actuate P2 thus effectuating a setting to zero of the chronograph hands as well as going out of the chrono mode. In this case, a complete simple chrono mode cycle has been completed.

actuate P1 and the chrono starts again taking account of the first measured time. One is then in the ADD mode.

b. Through a pressure on P2, the movement of the hands is interrupted whereas the electronic counter continues to run. One is in a SPLIT mode.

A new activation on P2 actuates again the hands which fly back to the state of the electronic counter.

During the rapid displacements of the hand, setting to zero of the chrono, fly back of the hands in SPLIT mode, the seconds hand 4, as well as the minutes hand 6 and the hours hand 8 displace independently and according to the shortest way to go.

The functions of the chronograph are controlled by a watch microprocessor associated with peripheral circuits.

The circuit comprises an application portion and entry and output interfaces and a processor portion with its control unit and its data treatment unit.

The circuit comprises four blocks of input interfaces corresponding to different members for the control of the functions :

Time Base

The circuit delivers the necessary times or clocks particularly for the time measurement but also for the sequency of the processor and for different logical realizations; it is principally composed of the following circuits :

32 kHz oscillator
digital frequency regulation through inhibition
division chain for the current time measure
division chain for the chrono
system realizing the reset and the start.

The adjusting of the frequency of the quartz is made by inhibition of a given number of cycles of 32 kHz during a period of 12 seconds.

This circuit controlling the inhibition comprises particularly non volatile memories (FAMOS) in which one charges the binary value corresponding to the desired setting.

Input Interfaces

The corrections of the time, the displacement of the hours hand is effected mechanically, through a first motor which is driven by the processor keeping up to date the registers as a function of the input signal during a control through the time setting stem.

When an entry of the controlled system is actuated, it activates a register actuating the processor and transmitting the information in a flag. The processor reads then the data contained in this flag and executes the function corresponding to the activated flag after which it resets it to zero thanks to the DATA field.

The circuit comprises the necessary blocks for the management of the members which it controls, particularly the control of the motors.

Processor Portion

The application program contained in the ROM memory, is a base of the working of the processor. The number of instructions which is contained and their format are adapted to the architecture of the microprocessor and to the functions to be realized.

The control unit is responsible for the managing of the processor and of the peripheral devices; it is composed by a ROM memory, a program counter, a sequencer and a decoder.

The ROM contains the application program from which the processor realizes different functions. Each instruction contained in the program is selected by the program counter and executed by the intermediary of the decoder and realizes the corresponding function by directing the different members of the treatment unit and the periphery devices. The sequencer controls the time sharing of all these operations.

The programm counter furnishes to the ROM memory the address of the instruction to be effectuated; afterwards without order from it, it increments the address of one step and delivers it to the ROM; however certain instructions can impose another address under certain conditions permitting therefore to make springs in the program or to go to sub-programs.

The sequencer manages the different steps necessary for the execution of these instructions.

The circuit used is principally composed of a binary divider, a flip-flop D and a logic circuit.

From a clock signal (16 kHz) it generates continuously execution cycles of these instructions until the activation of the HALT signal which blocks the sequence setting the processor to rest; the setting in function of the processor is obtained by means of the signal INT.

The decoder is a logic circuit which furnishes the necessary variables to the realization of the desired function.

The treatment unit performs the functions which are provided in the application program under the control of the control units. It is essentially constituted by a RAM memory and an arithmetic unit ALU.

The RAM memory is constituted of registers storing temporarly data such as the measured times, the dates and other data.

The arithmetic and logic unit is a circuit performing operations on the data for the execution of the application program.

The realization of this electronic circuit and of the method make use of known techniques and they will not be described here in further detail.

However, the electronic circuit and this processor permit the realization of at least two new and original functions which are the setting of the perpetual calendar (day, month, year) and of the hour as well as the saving of the data relative to the perpetual calendar at least when the end of the life time of the battery or the opening of the watch case is detected.

According to the present method, the setting of the perpetual calendar and of the hour is effectuated only by means of members integrated to the chronograph. To display the data introduced one uses the center seconds hand of the chronograph 4 cooperating with the graduation of the minutes 1 but as will be seen later on the amplitude of the unitary steps of this hand depends on the parameter which is set.

To enter into the initialization setting mode of the perpetual calendar, the user places the time setting stem in its second position, entirely pulled out by acting on the crown 11. Then one effects three pressures on the pusher P2 followed by three pressures on the pusher P1. The chronograph is then in its state I of the setting function, the seconds hand at the center 4 comes automatically in a position corresponding to the state of the year memory.

Figure 2:
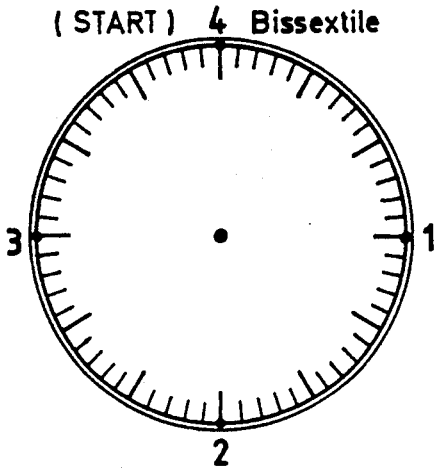
FIGS. 2 to 5 show schematically the visualisation, by means of the seconds hand located at the center and of the minutes graduation, of the different parameters to be set the year number, the month number and the day date and the time.

By pressing on the pusher P2, the chrono hand 4 is driven by steps of ¼ of revolution (75 motor steps) up to the value cf the year number 1,2,3 or 4 in a cycle of four years (FIG. 2). If the value of the number of the year which is thus displayed is not correct, the seconds chronograph hand 4 is driven forward at successive steps by pushing successively on the pusher P2. When the correct value is obtained the user pushes once on the pusher P1 placing the chronograph in the state II of the setting and the seconds hand 4 comes automatically back into a position corresponding to the state of the month memory.

Figure 3:
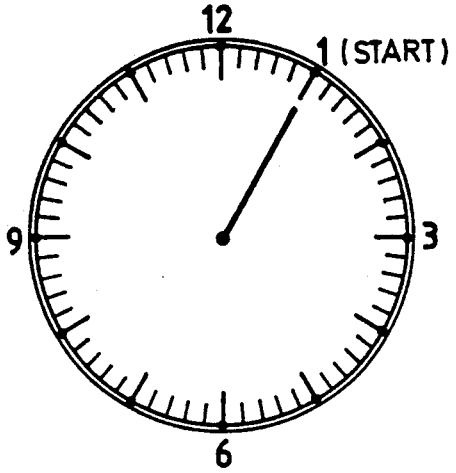

This state II corresponds to the setting of the number of the month. If this value is not correct the user drives the seconds hand 4 by successive steps of 1/12 of revolution (25 motor steps) by successive pressures on the pusher P2 until the correct value is reached (FIG. 3).

Figure 4:
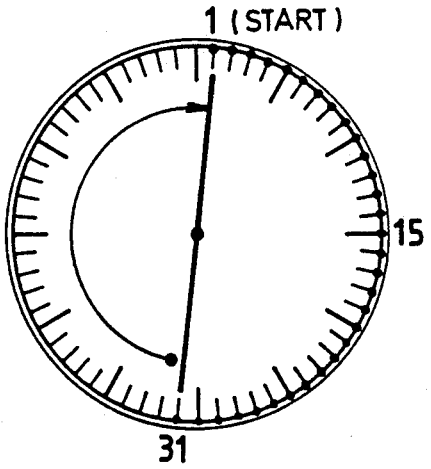

The user pushes once more on the pusher P1 memorizing the value of the month and passing to the state III of the setting function for the date (day) and the seconds hand 4 comes automatically into a position corresponding to the state of the date memory. If this value is not correct the user drives the hand 4 by successive steps of 1/60 of revolution by means of successive pressures on the pusher P2 until the exact value of the date is reached. If the value 28, 30 or 31 is passed (depending on the number of days of the month which has been introduced previously) the seconds hand 4 comes automatically to the start position and the cycle can start again (FIG. 4).

Figure 5:
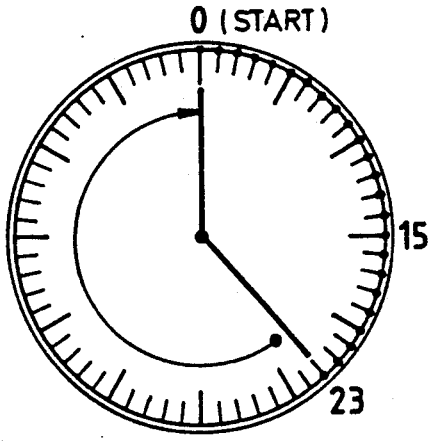

In this embodiment the function of the setting comprises a further state IV for the setting of the hour. By pushing once more on the pusher P1 the user passes to the state IV, the value of the date preceedingly adjusted and memorized and the seconds hand 4 is driven by steps of 1/60 of revolution (5 motor steps) until the value of the memorized hour. If this value is not correct the user causes the driving of the seconds hand 4 by steps of 1/60 of revolution up to the correct value. If during this operation it passes 23 steps, the seconds hand comes automatically to zero and the setting cycle of the hour can start again (FIG. 5). The user then presses once again on the pusher P1 memorizing the value of the hour and causing the setting to zero of the seconds hand 4 and the hand of the initialization function. The time setting stem is put again in normal retracted position.

This chronograph watch comprises further a function of end of life of the battery which takes place when the voltage delivered by the battery drops below a preestablished level, the seconds hand of the chronograph 4 on the position "10 seconds", the watch is stopped with the instantaneous memorization of its state including the values relative to the perpetual calendar in the FAMOS memory. An identical saving of the values is realized at each opening of the watch case by means of an appropriate switch of the watch case.

After the replacement of the battery, the closure of the watch case causes through the actuation of the watch switch the transfer of the values memorized in the FAMOS into the chronograph counter. The user causes then the fly back of the elapsed time through a rapid correction of the date and a time setting. After each closure of the watch case and before the fly back correction of the elapsed time, the watch chronograph can automatically pass through a non-static state during which the visualization of the state of the perpetual calendar is possible. Therefore, the user can verify that the perpetual calendar is set correctly or if not it can proceed to a new setting of said perpetual calendar.

Figure 6:
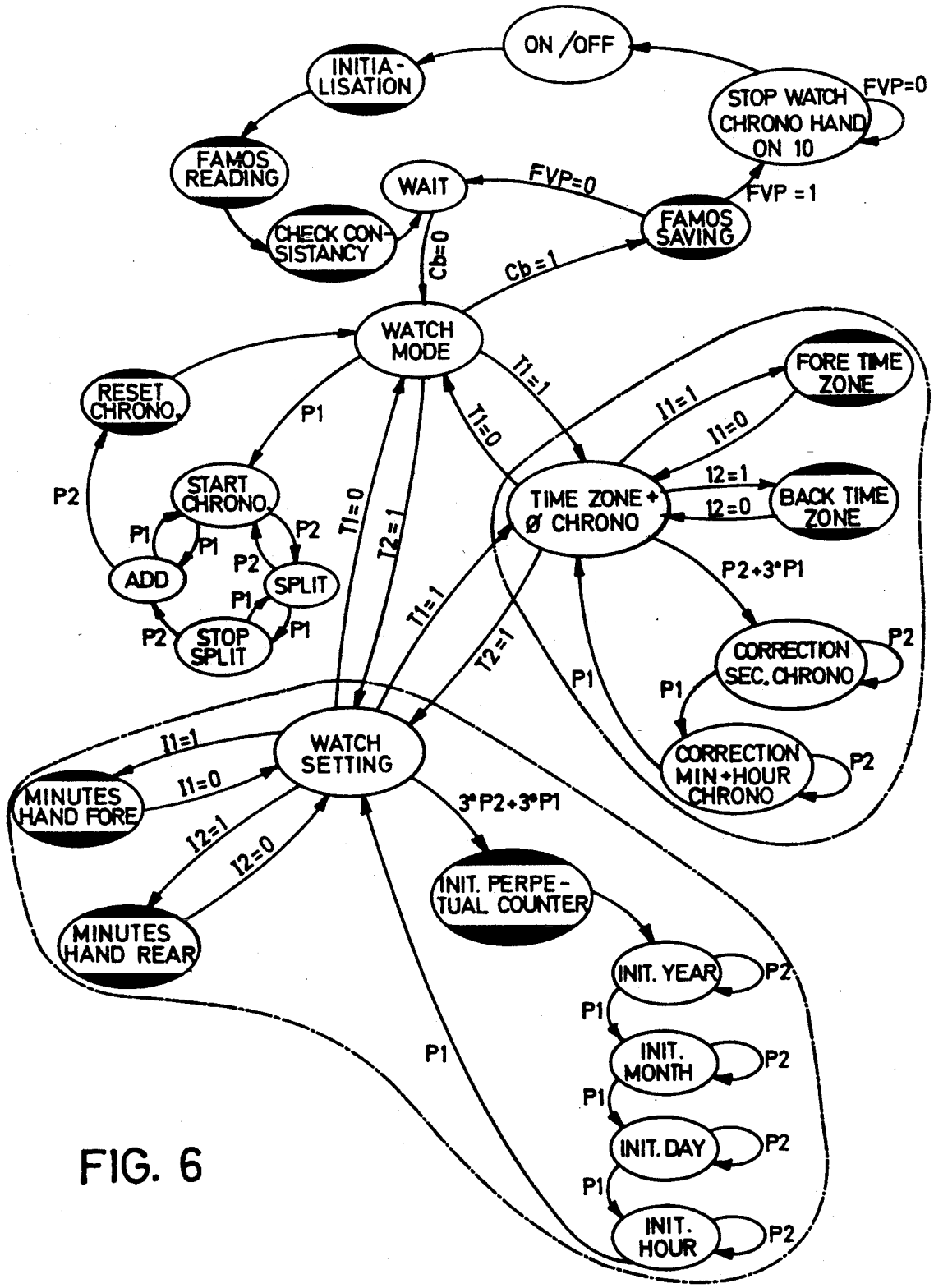
FIG. 6 shows a diagramm of states showing the different functions which can be realized with the chronograph watch according to the invention.

These different functions and other ones which the present chronograph watch is capable to realize are schematically displayed on FIG. 6, where :

T1 is the switch of the intermediate position of the time setting stem.

T2 is the switch of the completely pulled out position of the time setting stem.

Cb is the watch case switch indicating whether the watch case is open or closed and causing the saving of the values when the watch case is opened.

P1 is the first chronograph pusher

P2 is the second chronograph pusher

I1 is a switch actuated through the rotation of the crown 11 towards the right when it is in completely pulled out position or in intermediate position.

I2 is a switch which is actuated by the rotation of the crown 11 towards the left when it is in the completely pulled out position or in the intermediate position.

Therefore, a rotation of the crown 11 enables when the time setting stem is completely pulled out to displace forward respectively backward the minutes hand 3 for the time setting of the watch, the hour being set by the setting procedure of the perpetual calendar or through the function of the correction of the time zones forward or backward.

Therefore, for the first time, one has realized a method of setting of the perpetual calendar of a watch chronograph and of saving of its data in case of end of the life time of the battery by means of members which are exclusively integrated into the chronograph itself as well as a watch chronograph to carry out this method.

It is evident that a particular embodiment of the method and of the chronograph watch have been described by means of example but numerous variants, particularly in the procedure of the different control functions by means of the time setting stem and of the chronograph pushers can be thought of without departing from the scope of the protection claimed.

I claim:

1. A setting method of the perpetual calendar of a chronograph watch having an analogic display comprising a watch case, a time setting stem and first and second chronograph pushers; the time setting stem having a pulled out position in which said perpetual calendar can be set by manipulation of said pushers; a dial provided with a minutes graduation as well as a centered chronograph hand and eccentric chronograph displays for the minutes and the hours each presenting a graduation and a corresponding hand; at least a driving motor for these hands and an electronic circuit provided with a processor driven by a quartz time base, and a date display; said first pusher being adapted, upon being repeatedly pushed, to advance said centered chronograph hand stepwise to indicate on said minutes graduation the years of a leap year cycle, the months, the days and the hours, in that order, and said second pusher being adapted, upon being pushed, to enter the indicated year, month, day or hour in the perpetual calendar; the method comprising pulling said time setting stem out to said position, pushing said first pusher a sufficient number of times that said centered chronograph hand indicates the current year of a leap year cycle on said minutes graduation, pushing said second pusher to enter the indicated year in the perpetual calendar, pushing the first pusher a sufficient number of times to advance the centered chronograph hand to indicate the current month, pushing the second pusher to enter in the perpetual calendar the current month indicated by the centered chronograph hand, pushing the first pusher a sufficient number of times to advance the centered chronograph hand to cause the centered chronograph hand to indicate the current day on said minutes graduation, pushing said second pusher to enter in the perpetual calendar said current day indicated by the chronograph hand, pushing said first pusher a sufficient number of times to advance the centered chronograph hand to indicate the current hour on said minutes graduation, pushing said second pusher to enter in said perpetual calendar said current hour indicated by said centered chronograph hand, and pushing in said time setting stem.

2. A setting method as claimed in claim 1, wherein said centered chronograph hand is a seconds hand of the watch.

3. In a chronograph having an analogic display comprising a watch having a perpetual calendar, a time setting stem and first and second chronograph pushers; a dial provided with a minutes graduation and a centered chronograph hand as well as eccentric chronograph displays for the minutes and the hours, each presenting a graduation and a corresponding hand, as well as a date display comprising a circular eccentric graduation and a corresponding hand; at least two motors for the driving of these hands and an electronic circuit provided with the processor, controlled by a quartz time base and a date display; the improvement wherein said time setting stem has a pulled out position in which years, months, days and hours can be entered in said perpetual calendar by manipulation of said first and second pushers, said first pusher being adapted, upon being repeatedly pushed, to advance said centered chronograph hand stepwise along said minutes graduation until said centered chronograph hand indicates the current year of a leap year cycle by registry with said minutes graduation, said second pusher upon being depressed then being adapted to enter said indicated current year in said perpetual calendar, said first pusher being then adapted, upon being repeatedly pushed, to advance said centered chronograph hand about said minutes graduation to a point that indicates the current month, said second pusher upon being then depressed being adapted to enter said indicated current month in said perpetual calendar, said first pusher, upon being repeatedly pushed, being thereafter adapted to indicate on said minutes graduation the current day, said second pusher being thereafter adapted, upon being depressed, to enter said current day in said perpetual calendar, said first pusher then being adapted to be depressed a number of times sufficient to advance said centered chronograph hand to a point on said minutes graduation that indicates the current hour, said second pusher being then adapted, upon being depressed, to enter said current hour in said perpetual calendar, and said time setting stem upon being thereafter pushed back in being adapted to return the chronograph to a time telling function.

4. A chronograph as claimed in claim 3, wherein said centered chronograph hand is a seconds hand of the watch.

* * * * *